US008601924B1

(12) United States Patent
Minond et al.

(10) Patent No.: US 8,601,924 B1
(45) Date of Patent: Dec. 10, 2013

(54) FILM WRAP CUTTING APPARATUS

(75) Inventors: Joseph Minond, East Brunswick, NJ (US); Marcelo Alcantara, Lanus Este (AR)

(73) Assignee: XPAK USA, LLC, North Brunswick, NJ (US)

( * ) Notice: Subject to any disclaimer, the term of this patent is extended or adjusted under 35 U.S.C. 154(b) by 157 days.

(21) Appl. No.: 13/199,583

(22) Filed: Sep. 2, 2011

(51) Int. Cl.
*B26D 5/20* (2006.01)
*B26D 5/08* (2006.01)

(52) U.S. Cl.
USPC ..... 83/214; 83/564; 83/565

(58) Field of Classification Search
USPC ..... 83/564, 614, 169, 829, 821, 597, 389.3, 83/946, 389, 214, 565; 53/381.2; 29/426.4
See application file for complete search history.

(56) References Cited

U.S. PATENT DOCUMENTS

| | | | | |
|---|---|---|---|---|
| 3,263,843 | A * | 8/1966 | Grahn et al. | 414/412 |
| 3,948,402 | A * | 4/1976 | Schott, Jr. | 414/412 |
| 4,287,801 | A * | 9/1981 | Hanson | 83/871 |
| 4,581,970 | A * | 4/1986 | Hanson | 83/871 |
| 5,725,349 | A * | 3/1998 | Garvey et al. | 414/412 |
| 7,174,695 | B2 * | 2/2007 | Porter et al. | 53/381.2 |
| 7,240,598 | B2 * | 7/2007 | Wang | 83/863 |
| 7,549,274 | B2 * | 6/2009 | Fraser | 53/492 |

* cited by examiner

*Primary Examiner* — Sean Michalski
*Assistant Examiner* — Jonathan G Riley
(74) *Attorney, Agent, or Firm* — Michael R. Philips

(57) ABSTRACT

An apparatus is provided for cutting a film wrapped around a tray containing full bottles. The apparatus has a tray supporting surface formed with a pair of mirror image arcuate slots. A pair of knives are mounted to conveyor mechanisms to be driven in paths for cutting the film wrap on the bottom surface of the tray in the form of an X. A pair of adjustable side rails and a retracting stop are positioned to locate the tray for accurate film cutting. The knives travel sequentially to avoid interference as their paths intersect at the apex of each conveyor mechanism. Subsequent to cutting the film wrap, an operator is able to lift the film wrap off the tray and bottles to enable the bottles to be lifted and moved for creating a variety sales unit containing multiple drink flavors in the same tray.

11 Claims, 4 Drawing Sheets

L
L

FILM WRAP CUTTING APPARATUS

FIELD OF THE INVENTION

The present invention relates to the field of packaging machinery, and more particularly to machinery for cutting a film wrap from trays prior to removing the film wrap to access the tray contents.

BACKGROUND OF THE INVENTION

Bottled drinks in flavors are very popular. These flavored bottled drinks may be intended for energy or performance enhancement, or simply to satisfy a thirst. Bulk merchandise stores, e.g. Costco, Sam's Club, are also popular since they give the customer an actual or perceived value by selling products in larger sales units. In this way, bulk merchandise stores have become a popular consumer source of flavored bottled drinks.

Bottling plants that provide these flavored drinks, for reasons of efficiency, produce and bottle a single flavor of drink for as long as possible. The bottling plant will fill bottles with a flavor, place the filled bottles in reusable shallow corrugated trays and wrap the trays with a transparent film sheet for storage and shipping. The packed tray may contain 12, 24 or other quantity of filled bottles. Trays are then placed on pallets for shipment. A bottling plant may fill and warehouse a single flavor drink for weeks before switching to a different flavor.

However, customers are expressing a preference to buy a variety of flavors rather than a tray containing 24 bottles of a single flavor. A demand has been found for bottled drinks in a tray containing a variety of flavors. In a tray, e.g. of 24 bottles, 6 bottles of each of four flavors has become a recently popular sales unit in the bulk merchandise stores. Since the bottling plants are set up to run long production batches of a single flavor, creating a variety sales unit tray must be treated as a secondary operation. The secondary operation, a mixing plant, will reuse the original trays for reasons of economy.

In the process of converting single flavor trays to multiple flavor trays, the film wrap covering the input single flavor tray noted above must first be removed before the bottles can be lifted and transferred to another tray. Current film wrap removal has been a fully manual operation in which the worker places the single flavor tray on a surface, inverts the tray and contents, cuts an "X" or other pattern through the film covering the tray bottom, re-inverts the tray to upright, and pulls the film up and off to expose the bottles, depicted in FIGS. 1A-1D of this application. A tray filled with 24 bottles containing 16 ounces of liquid each weighs approximately 50 pounds. In addition to the time involved and the strenuous act of inverting the tray of bottles twice, the manual cutting frequently damages the trays and may result in the worker sustaining cuts to the hands, worker injury and increased insurance costs. When a cut involves bleeding, the bottle processing operation must be shut down and disinfected according to Federal Food And Drug Administration regulations, a process that takes approximately 45 minutes. During this 45 minute cleaning, no production is accomplished on this conveyor line.

Therefore, a need exists for an apparatus for assisting in removing the film wrap from a tray of filled bottles that reduces the time and labor involved, reduces the damage to the trays, and eliminates the danger of worker injury.

SUMMARY OF THE INVENTION

The present invention provides an apparatus for cutting the film wrap covering a tray of filled bottles in a manner to overcome the drawbacks outlined above. The worker places the full, film-wrapped tray on a cutting table and presses two actuator switches simultaneously. A photoelectric curtain safety barrier is activated to guard against the worker placing a hand in the cutting area while the apparatus is operating. A pair of knives are driven sequentially along a pair of mirror image paths that approximate an X-shape, cutting the film wrap covering the bottom of the tray. The film is cut with minimum contact to the tray. The worker then grasps the film wrap on opposed sides of the tray and removes the film wrap, and the tray full of bottles is moved to the mixing station. The act of inverting the tray and bottles manually has been eliminated.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figures 1A, 1B, 1C, 1D:
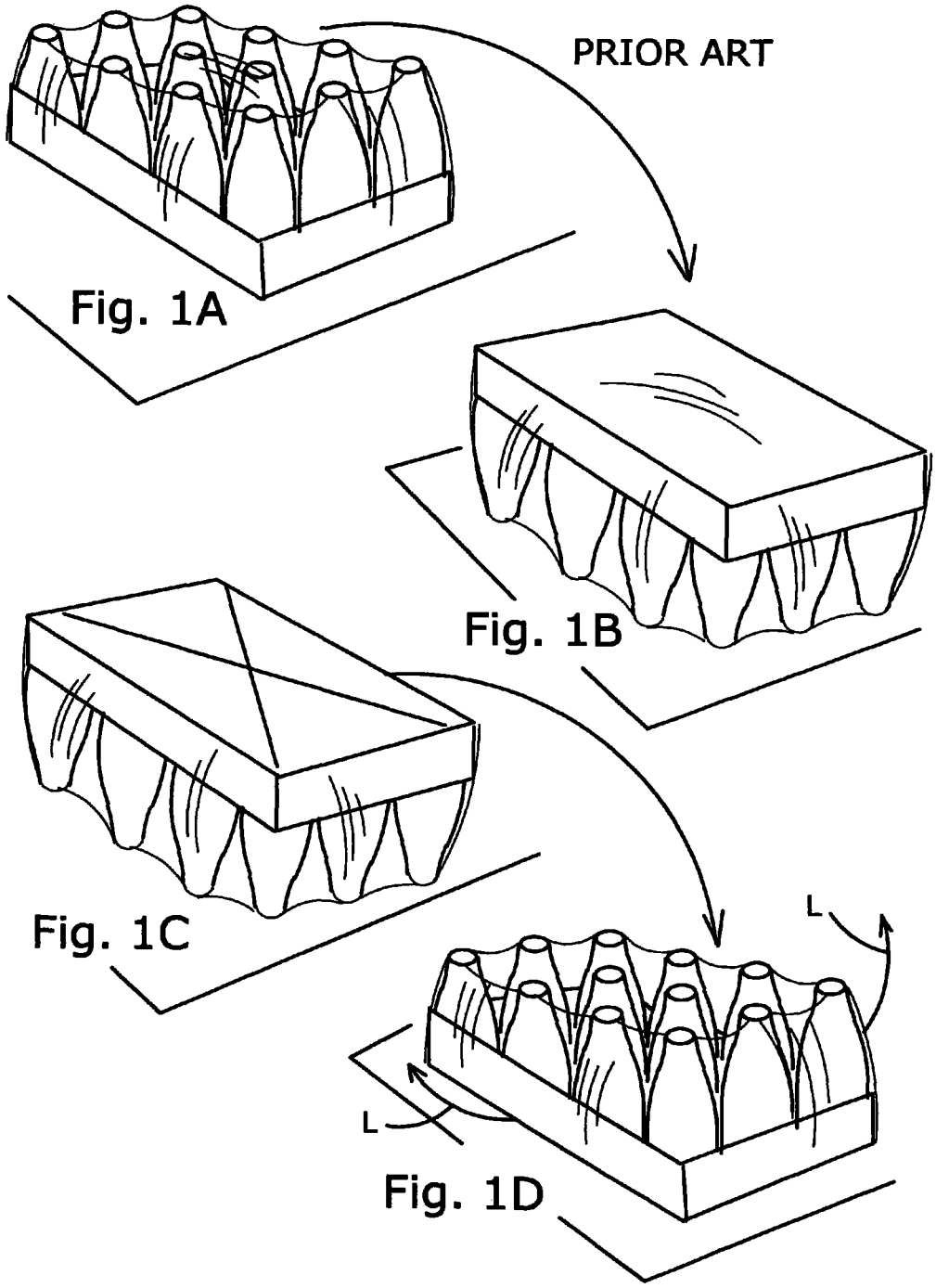
PRIOR ART Fig. 1A
FIGS. 1A-1D depict a sequence according to the prior art in which the filled tray is inverted, the film wrap is manually slit on the bottom surface, and the tray is re-inverted to upright.

Referring to FIGS. 1A-1D, the process for cutting a film wrap around a tray carrying a plurality of filled bottles according to the prior art is depicted in three steps. FIG. 1A shows a tray containing filled bottles in upright orientation as the tray is transferred from an incoming pallet to a cutting surface. The tray and bottles are enclosed in a transparent film that is heat sealed. The bottles each typically contain 16 fluid ounces of drink, weighing 2.1 pounds each. A tray holding 24 such bottles weighs approximately 50 pounds. A worker next inverts the tray of full bottles to the position shown in FIG. 1B in order to expose the tray bottom for cutting. As illustrated in FIG. 1C, the worker has cut the film wrap twice to form an X-shape that will enable the film wrap to be removed in a single piece. The manual cutting operation is generally done with a utility knife or a box cutter having a sharp blade that is extended for use and retracted for storage. The worker attempts to cut through only the film wrap, but in order to be certain of severing the film in a single pass for each cut line, the tray may also be cut. The tray is formed of cardboard, and damage from cutting can weaken the bottom to the degree that the tray will no longer safely support a 50 pound load. Therefore, damaged trays must be replaced. After forming the X-shape cut through the film wrap bottom, the tray and bottles are again inverted to be upright, as seen in FIG. 1D. The worker next grasps the side portions of film wrap near the tray bottom and pulls upward in the directions indicated by arrows L to remove the film wrap and expose the bottles.

As mentioned briefly above, in addition to the damage caused to trays by the manual cutting operation, there are other drawbacks to this process. A first drawback is that the worker is required to invert each 50 pound tray of bottles twice, causing considerable muscle strain and fatigue. A second drawback of this manual cutting operation is that in handling 50 pound trays, a tray will be dropped occasionally, damaging bottles of liquid and requiring cleanup. A third and major drawback of this manual cutting operation is worker injury, resulting in a need to clean and treat a wound, as well as to stop the production line to disinfect the areas contaminated by blood, drastically affecting productivity. Worker injury and increased insurance costs are potentially significant.

Figure 2:
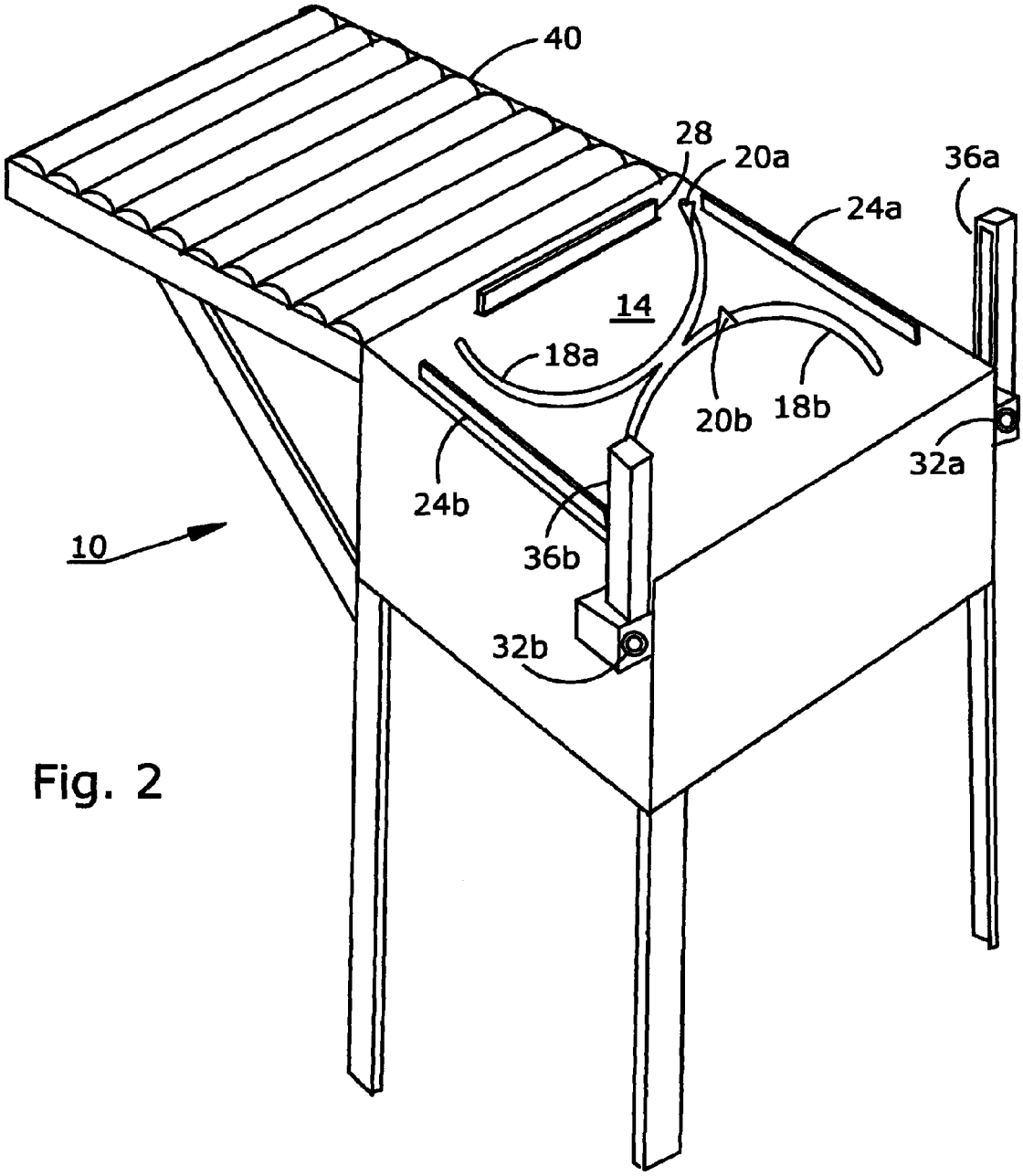
FIG. 2 is a top perspective view of a film cutting apparatus according to the present invention.

Referring now to FIG. 2, a film wrap cutting apparatus 10 of the invention is illustrated in top perspective view. Film wrap cutting apparatus 10 is generally in the form of a table with the main mechanical components mounted within, as will be described in detail below. The upper surface of apparatus 10 is a plate 14 that is oriented substantially horizontally and adapted for supporting a tray full of bottles. A pair of arcuate slots 18*a* and 18*b* are formed through plate 14 with a central portion of slot 18*a* overlapping a central portion of slot 18*b*. A first knife 20*a* is shown with a point thereof extending through slot 18*a* to be visible above plate 14. A second knife 20*b* is shown with a point thereof extending through slot 18*b* to be visible above plate 14. Knives 20*a*, 20*b* extend above plate 14 by a height sufficient to cut through the film wrap without damaging the tray. In operation, a tray of bottles is placed upright on plate 14 with the bottom of the film wrap in contact with surface 14. Knife 20*a* is driven along slot 18*a* and knife 20*b* is driven along slot 18*b* to make a pair of intersecting arcuate cuts through the bottom film wrap on the tray. Knife 20*b* is not positioned directly opposite to knife 20*a* in order for knives 20*a*, 20*b* to travel in sequence and not collide. The two arcuate cuts approximate the X-shape cuts formed manually and described above in respect to FIG. 1C. Whereas the preferred embodiment of the invention employs arcuate slots 18*a*, 18*b*, it is understood that alternate slot shapes and travel paths for knives 20*a*, 20*b*, e.g. partial trapezoid shapes, are considered within the scope and concept of the present invention.

Referring further to FIG. 2, a pair of rails 24*a* and 24*b* are provided along opposed side edges of plate 14. Rails 24*a*, 24*b* are separated by a distance slightly greater than the width of a tray to be processed in apparatus 10. Rails 24*a*, 24*b* are preferably assembled to plate 14 in a manner to allow for adjustment of the distance therebetween to accommodate different size trays as required. A moveable stop 28 is provided adjacent to an end of plate 14. Stop 28, as illustrated, is automatically moved intermittently upward and downward through a slot in plate 14 to allow the worker to quickly and accurately position a tray in the proper location for cutting the film wrap. At the end of the cutting process, stop 28 automatically retracts downward through plate 14 to allow the worker to push a second tray onto plate 14 while moving the first tray off of plate 14 and onto conveyor 40. Conveyor 40 may be of the gravity or driven types. It will be understood by those skilled in the art that alternate forms of moveable stop may be employed for positioning the tray as described. It will be further understood that the tray may be placed on plate 14 in the space between rails 24*a*, 24*b* by mechanical means, e.g. a robot arm.

Once the worker has placed a tray on plate 14, the worker initiates the mechanical actions by contacting both switches 32*a* and 32*b* simultaneously. The circuit activated by switches 32*a*, 32*b* initiates a single cycle rotation of knives 20*a*, 20*b*. As a further safety feature, a pair of photoelectric transmitters and receptors 36*a* and 36*b* are provided adjacent to the entry portion of plate 14. Photoelectric transmitters and receptors 36*a*, 36*b* are in the form of a light curtain to encompass a broad area, and are capable of emitting a signal for quickly stopping the mechanical action in case a worker breaks the light curtain with a hand or arm.

Figure 3:
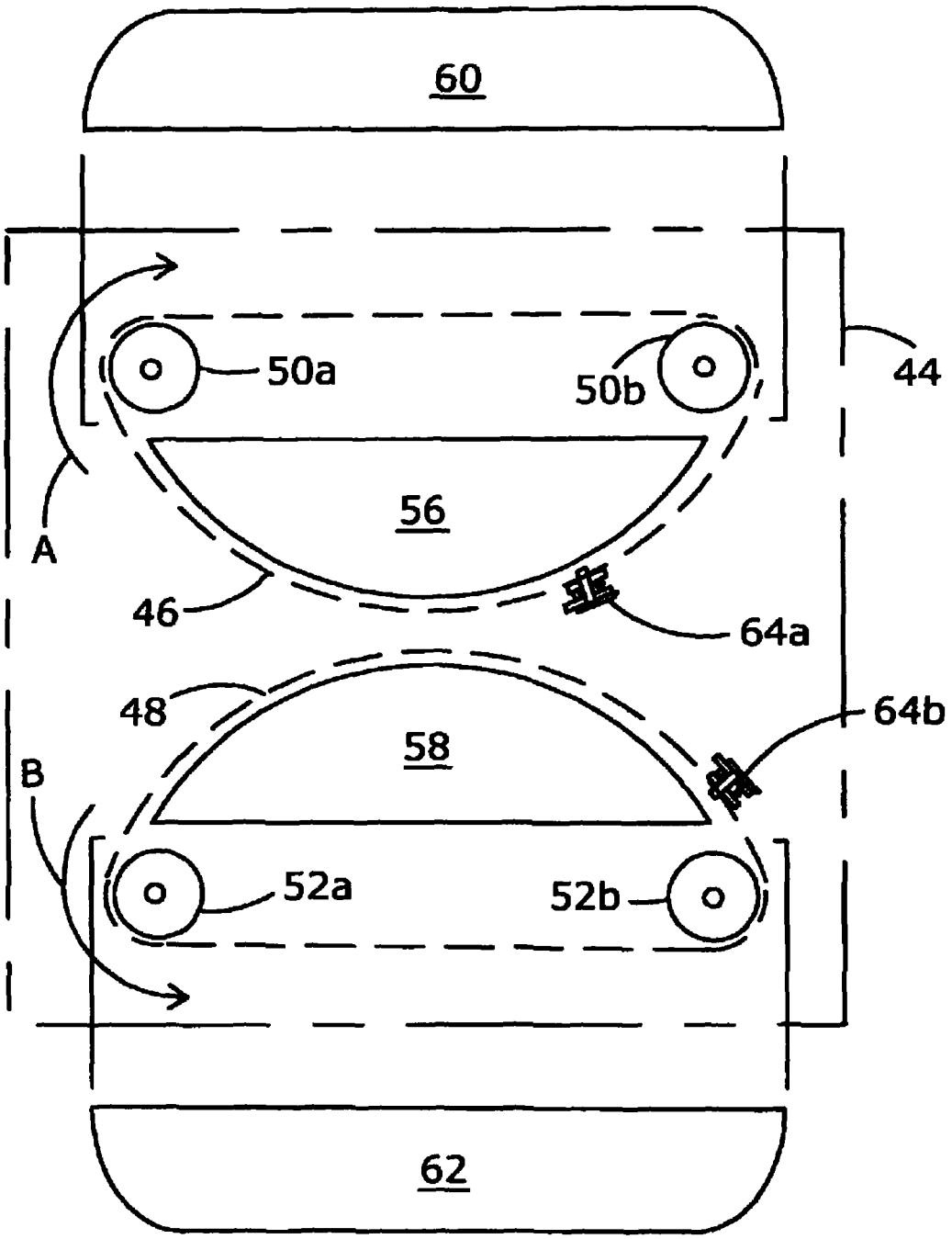
FIG. 3 is a partially exploded top plan view of the knife driving mechanism of the invention.

Referring now to FIG. 3, a top plan view of a pair of mirror image conveyor mechanisms is illustrated as mounted to a base 44 (shown in long and short dashes) below plate 14 (FIG. 2). Chain 46 is mounted around a drive sprocket 50*a* and an idler sprocket 50*b* for rotation in a substantially semi-circular path defined by a guide plate 56. Chain 48 is mounted around a drive sprocket 52*a* and an idler sprocket 52*b* for rotation in a substantially semi-circular path defined by a guide plate 58. Chain 46 and chain 48 are mounted to be substantially coplanar. Sprockets 50*a*, 50*b*, 52*a*, 52*b* are rotatably mounted to base 44. Drive sprocket 50*a* and drive sprocket 52*a* are synchronously driven by a driver, e.g. a servo motor (not shown), with appropriate drive and speed control. The servo motor may be programmed to drive the mechanism through a single cycle and stop or be stopped by a signaling device. Knife carrier assembly 64*a* is affixed to the exterior surface of a chain 46. Knife carrier assembly 64*b* is affixed to the exterior surface of a chain 48. In operation, chain 46 is driven clockwise as indicated by arrow A, and chain 48 is driven counterclockwise as indicated by arrow B. Although chains 46, 48 and guide plates 56, 58 are seen as mirror images of one another, knife conveyor assemblies 64*a*, 64*b* are cyclically offset from each other. In this manner, when chains 46, 48 are simultaneously driven in the directions indicated by arrows A and B, knife carrier assembly 64*a* passes the apex of guide plate 56 before knife carrier assembly 64*b* has reached the apex of guide plate 58, therefore avoiding an interference. As knife carrier assemblies 64*a*, 64*b* follow their respective semi-circular travel paths beneath a film wrapped tray, the knives cut a pattern in the bottom film covering that approximates an X-shape.

Referring further to FIG. 3, a cam plate 60, shown out of the mounting position, is assembled to cover sprockets 50*a*, 50*b*. Similarly, a cam plate 62 is assembled to cover sprockets 52*a*, 52*b*. Cam plates 60, 62 are assembled to base 44 and spaced above respective sprockets 50*a*, 50*b*, 52*a*, 52*b*. As knife carrier assembly 64*a* completes the arcuate portion of the travel path around guide plate 56 and approaches sprocket 50*a*, knife carrier assembly 64*a* is retracted by cam plate 60 in order to prevent further cutting of the film wrap. Knife carrier assembly 64*b* is similarly retracted by contact with cam plate 62 when knife carrier assembly 64*b* approaches sprocket 52*a*. At the completion of the cutting cycle, knife carrier assemblies 64*a*, 64*b* are each positioned along the linear portion of their respective cycles and under each respective cam plate 60, 62 to retain each knife carrier assembly 64*a*, 64*b* below the surface of plate 14 (see FIG. 2). At the point that knife carrier assemblies 64*a*, 64*b* respectively reach the arcuate portion of their travel paths beyond sprockets 50*b*, 52*b*, plates 60, 62 release knife carrier assemblies 64*a*, 64*b* to enable film cutting.

Figure 4A:
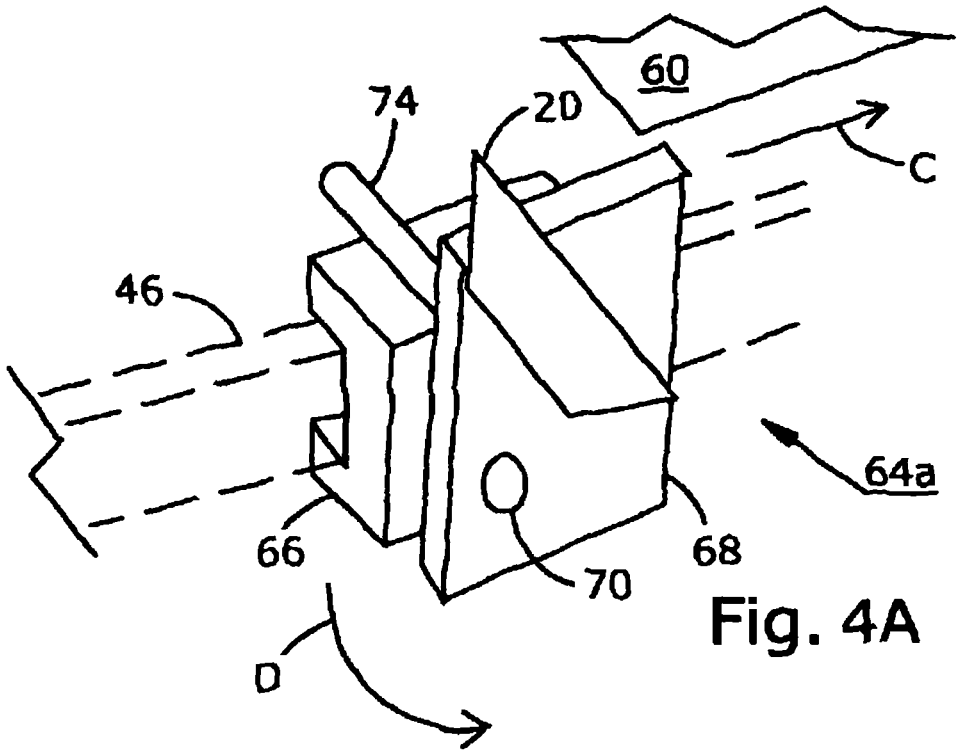
FIGS. 4A and 4B are enlarged side perspective views of a knife carrier assembly during film cutting and between cutting sequences, respectively.

Referring now to FIG. 4A, knife carrier assembly 64*a* is shown in enlarged perspective view affixed to chain 46 (shown in dashed lines). Knife carrier assembly 64*a* comprises a clamp block 66 that is formed with a channel sized for engaging chain 46 with fastening means, e.g. set screws. A knife holder 68 is pivotally connected to clamp block 66 by a pivot pin 70 to allow knife holder 68 to rotate a limited amount in the direction indicated by arrow D. A cam rod 74 is affixed to the back surface of knife holder 68 and extends over the top of clamp block 66. Knife carrier assembly 64*a* and chain 46 travel in the direction indicated by arrow C. Knife blade 20 is free to rotate in the direction indicated by arrow D when cam rod 74 is pressed against the leading edge of cam plate 60. A spring (not shown) causes knife holder 68 to return to the cutting position as seen in FIG. 4A.

Figure 4B:
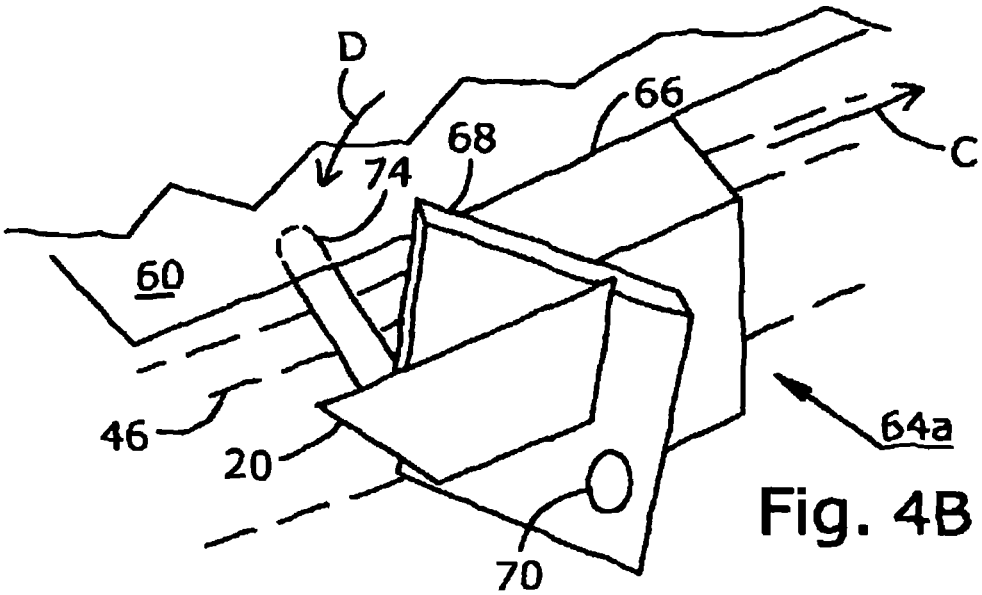

Referring now to FIG. 4B, knife carrier assembly 64*a* is shown with knife 20 in retracted orientation after cam rod 74 has contacted cam plate 60. In this orientation, the cutting edge (long edge) of knife 20 is substantially horizontal to avoid contact with the bottom of the film wrapped tray as knife carrier assembly 64*a* is conveyed along the linear portion of the travel path, i.e. after the X-shape has been cut through the film wrap covering the tray bottom.

To reiterate the operational sequence according to the invention, a worker or robot places a first tray containing full bottles that is wrapped with film onto a tray supporting surface having a pair of arcuate slots formed therethrough. The tray is positioned between a pair of side rails and against a moveable stop. The operator presses two start switches simultaneously. A first knife is driven by a chain mechanism to contact the bottom of the film wrap following an arcuate path in a clockwise direction. A second knife is driven by a chain mechanism sequentially after the first knife to contact the bottom of the film wrap following an arcuate path in a counterclockwise direction. The two arcuate travel paths of the knives slightly overlap to form an X-shape cut in the film wrap. After cutting the film bottom, the first and second knives are pivoted to positions below the tray supporting surface and the conveyor mechanisms are deactivated. The stop is retracted below the tray supporting surface. The operator removes the cut film wrap from the tray and bottles contained therein and discards the cut film wrap. The operator places another film wrapped tray containing full bottles onto the tray supporting surface, pushing the first tray onto a tray conveyor. The stop is moved upward to position the second tray. The operator presses the two start switches simultaneously.

While the description above discloses preferred embodiments of the present invention, it is contemplated that numerous variations and modifications of the invention are possible and are considered to be within the scope of the claims that follow.

What is claimed is:

1. A film wrap cutting apparatus, comprising:

a. a surface for supporting a tray having a first slot and a second slot formed therethrough;

b. a first conveyor mechanism mounted to a base, and positioned below the supporting surface;

c. a second conveyor mechanism mounted to the base and positioned below the supporting surface to be substantially co-planar with the first conveyor mechanism;

d. a first knife mounted to the first conveyor mechanism in a manner for a portion of the first knife to extend through the first slot through the tray supporting surface;

e. a second knife mounted to the second conveyor mechanism in a manner for a portion of the second knife to extend through the second slot through the tray supporting surface;

f. means connected to the first conveyor mechanism and the second conveyor mechanism to drive the first and second knives in opposite cyclical directions; and g. means for retracting the first knife and the second knife to positions below the tray supporting surface.

2. The film wrap cutting apparatus described in claim 1, wherein the first conveyor mechanism and the second conveyor mechanism are substantially semi-circular in shape.

3. The film wrap cutting apparatus described in claim 2, wherein the second conveyor mechanism is formed substantially as a mirror image of the first conveyor mechanism.

4. The film wrap cutting apparatus described in claim 1, wherein the first knife and the second knife are operative for cutting a pattern through the film wrap substantially in the form of an X, dividing the film to form four points directed toward a common center.

5. The film wrap cutting apparatus described in claim 1, wherein the first conveyor mechanism and the second conveyor mechanism are commonly driven.

6. The film wrap cutting apparatus described in claim 1, wherein the means for retracting the first knife comprises a first knife carrier assembly for mounting the first knife to the first conveyor mechanism in a manner allowing the first knife to pivot from a first orientation for cutting the film wrap to a second orientation for not contacting the film wrap.

7. The film wrap cutting apparatus described in claim 6, wherein the first knife carrier assembly is configured for holding the first knife in the first orientation in a position for cutting the film wrap with minimum tray contact.

8. The film wrap cutting apparatus described in claim 6, further comprising means for pivoting the first knife from the first orientation to the second orientation.

9. The film wrap cutting apparatus described in claim 1, wherein the means for retracting the second knife comprises a second knife carrier assembly for mounting the second knife to the second conveyor mechanism in a manner allowing the second knife to pivot from a first orientation for cutting the film wrap to a second orientation for not contacting the film wrap.

10. The film wrap cutting apparatus described in claim 9, wherein the second knife carrier assembly is configured for holding the second knife in the first orientation in a position for cutting the film wrap with minimum tray contact.

11. The film wrap cutting apparatus described in claim 9, further comprising means for pivoting the second knife from the first orientation to the second orientation.

* * * * *